United States Patent [19]

Rinehart

[11] 4,206,066

[45] Jun. 3, 1980

[54] HIGH IMPACT - ARC TRACK AND WEATHER RESISTANT POLYMER INSULATOR AND COMPOSITION INCLUDING EPOXIDIZED CASTOR OIL

[75] Inventor: William M. Rinehart, Centralia, Mo.

[73] Assignee: A. B. Chance Company, Centralia, Mo.

[21] Appl. No.: 925,367

[22] Filed: Jul. 17, 1978

[51] Int. Cl.[2] ..... H01B 3/40

[52] U.S. Cl. ..... 252/63.2; 174/110 E; 174/137 B; 174/DIG. 1; 260/18 EP; 252/63.5

[58] Field of Search ..... 252/63, 63.2, 63.5; 260/18 EP; 174/137 B, DIG. 1, 110 E

[56] References Cited

U.S. PATENT DOCUMENTS

| | | | |
|---|---|---|---|
| 2,997,527 | 8/1961 | Kessel et al. | 174/110 E X |
| 3,351,574 | 11/1967 | Hicks et al. | 260/18 EP |
| 3,445,282 | 5/1969 | Olson et al. | 260/830 TW X |
| 3,511,922 | 5/1970 | Fisch et al. | 174/137 B |
| 3,741,929 | 6/1973 | Burton | 260/40 R |
| 3,838,055 | 9/1974 | Rinehart | 252/63.2 |
| 4,032,393 | 6/1977 | Alfeis et al. | 428/920 X |

*Primary Examiner*—Harris A. Pitlick

*Attorney, Agent, or Firm*—Schmidt, Johnson, Hovey & Williams

[57] ABSTRACT

An arc track resistant, high voltage, filled synthetic resin insulator is disclosed which exhibits a wide range of desirable qualities heretofore unobtainable with any single type of prior insulator. The insulator hereof unexpectedly gives excellent arc track and flame resistance, along with a flexibilized yet rugged construction having good weatherability properties. These qualities are achieved through use of a relatively critical selection of components and proportions which also facilitate cast construction of the insulators by giving a pourable, yet highly filled liquid casting composition during the fabrication stage. The insulators include critical quantities of hydrated alumina (from about 60 to 75% by weight) and a synthetic resin matrix having expoxidized castor oil (18 to 24% by weight) and a glycidyl rigidizer therein, along with a curing agent and accelerator.

11 Claims, 2 Drawing Figures

HIGH IMPACT - ARC TRACK AND WEATHER RESISTANT POLYMER INSULATOR AND COMPOSITION INCLUDING EPOXIDIZED CASTOR OIL

BACKGROUND OF THE INVENTION

1. Field of the Invention

This invention broadly relates to polymeric, alumina filled cast synthetic resin insulators typically used by electrical utilities in connection with their transmission and distribution systems. More particularly, it is concerned with the discovery that certain relatively critical components and proportions thereof can be employed to give a filled synthetic resin insulator having a large number of very desirable properties in the field, while at the same time giving a pourable casting composition which greatly facilitates initial production of the insulator. That is to say, combined in the insulators of the present invention are properties such as excellent arc track and flame resistance, good weatherability, high impact strength without excessive brittleness, and the ability to fabricate the insulators by conventional casting techniques even though the fill loading of the casting compositions is very high, on the order of 60 to 75% by weight.

2. Description of the Prior Art

Elongated, skirted insulators of various types have been in use in the electrical transmission and distribution industry for many years. To be effective, such insulators must be able to withstand ambient weather conditions and be produceable at relatively low cost. The fact that many researchers in the field are still at work in attempting to perfect outdoor high voltage insulators amply attests to the fact that no single insulator construction heretofore available has met all of the criteria needed for long term, trouble-free operation.

For example, porcelain has long been the material of choice for construction of outdoor high voltage insulators. This is because procelain has outstanding weatherability and superior arc track resistance, along with high compressive strength. However, the high weight to strength ratio in brittleness of porcelain insulators is a severe problem from a fabrication handling and use standpoint, resulting in relatively high loss factors. For example, porcelain insulators shatter to a very satisfactory degree when struck by a bullet, and therefore make prime targets for hunters or vandals bent upon destruction. Also, in contaminated areas, porcelain insulators must be coated with a grease-like material that encapsulates dirt particles, in order to keep the dirt from forming a conductive path on the porcelain surface. In order to avoid flashover problems, porcelain insulators must be cleaned and recoated every six months to two years depending upon local conditions—a very costly but necessary operation. As a consequence of the above problems, many utilities have been seeking effective synthetic resin insulators which do not possess the limitations of porcelain and can compete with the long range durability of the latter.

In order to meet this demand, producers have developed a wide variety of synthetic resin based insulators. In general, these have proven to be deficient in one or more important areas such as arc track resistance, weatherability, impact strength or castability.

One class of synthetic resin insulators heretofore available have been formed using relatively high quantities of curable, hydrophobic, thermosetting synthetic resins such as 2,2-bis(p-hydroxyphenyl)propane glycidyl ether polymers (commonly called glicidyl ethers of Bisphenol A type epoxies and referred to herein for convenience as bisphenol A resins or BPA resins). If desired, the resin may be reinforced with a material having insulating properties such as glass fibers. BPA epoxy resins have heretofore been considered to be the most practical base material for porcelain substitutes since they more nearly meet all of the requirements outlined above at a reasonable cost. However, actual commercial practice with BPA epoxy based insulating products in electrical applications has proven that these insulators tend to track, especially after exposure to ambient atmosphere for an extended period. For example, while conventional BPA epoxy resin has excellent properties insofar as dielectric constant, mechanical strength, electrical resistance, and ability to be molded are concerned, such resins when cured with an anhydride and accelerated with an amine accelerator exhibit poor arc track resistance, especially after extended weathering. Thus, a simple unmodified BPA epoxy resin is not the real answer to the problems presented.

It is also known that a conventional BPA epoxy system can be modified to increase the arc track resistance thereof by the addition of a filler thereto such as hydrated alumina. Fillers are advantageous not only because of the increase in arc track resistance obtained thereby, but also by virtue of the fact that use of such fillers correspondingly lowers the amount of synthetic resin material required, thereby lowering production costs. However, such hydrated alumina fillers have the negative effects of increasing the brittleness of the final insulator and making fabrication difficult, especially at high loadings. Specifically, when it is attempted to use filler concentrations of 50% or more by weight, the viscosity of the casting composition increases very rapidly to the point that the composition is not pourable. This problem is particularly acute when smaller particle size alumina is employed. As will be appreciated, lack of easy pourability not only slows the casting process, but can also create voids in the outer surface of the insulator which in turn collect dirt and tend to establish a conductive track across the insulator, and create hidden voids at the interface between the skirt material and the internal glass reinforced epoxy rod. In addition, high filler loadings can be troublesome in that during casting the filler can settle, thus giving a nonuniform composition throughout the insulator.

Because of problems encountered with BPA resin products, cycloaliphatic epoxies have been suggested as an alternate (see U.S. Pat. No. 3,511,922). The cycloaliphatics are of particular interest because, being aliphatic, they tend to burn with a clean flame. The aromatic materials on the other hand burn with a dirty soot-filled flame which tend to form carbon. Thus, under arcing conditions aromatic systems (e.g., BPA epoxies) tend to form a carbon path or track, while the aliphatic systems erode. However, cycloaliphatic systems have been found to be deficient in terms of impact strengths, particularly when filled. Also, cycloaliphatic systems tend to exhibit high erosion rates and flammability.

It has also been suggested to employ aliphatic epoxy resins in connection with electrical insulators (see U.S. Pat. Nos. 3,838,055 and 3,351,574, both of which are incorporated herein by reference). The insulators described in U.S. Pat. No. 3,838,055 preferably include a BPA resin cross linked with a polyglycidyl ether polymer of castor oil. These types of insulators are designed to operate without addition of filler.

Other patents of background interest include: U.S. Pat. Nos. 3,475,546, 3,535,289, 3,551,551, 3,571,491, 3,622,537, 3,645,889, 3,511,922, 3,044,900, 3,567,677, 3,446,741, 3,470,110, 3,445,282, 3,351,574, 3,497,531, 3,251,801 and 3,476,702.

SUMMARY OF THE INVENTION

The problems outlined above are in large measure solved by the insulators of the present invention. Broadly speaking, the insulators hereof are high voltage, arc track resistant, polymeric based insulators which are in the form of a body, usually elongated and provided with spaced, circumferential skirts, which has at least the outermost portion thereof formed of a cured, filled synthetic resin composition. Although the insulators can be formed solely of the filled composition, in many cases it is advantageous both from a cost and strength standpoint to provide a core such as an elongated rod formed of fiberglass or the like.

In any event, the outermost portion of the insulator is a synthetic resin composition characterized by relatively critical selections of components and proportions, in order to achieve the desired end results. More particularly, the synthetic resin matrix preferably includes from about 18 to 22% by weight of epoxidized castor oil which is reacted with a glycidyl rigidizer and an anhydride curing agent. A quantity of particulate filler (either treated or untreated hydrated alumina) is dispersed throughout the synthetic resin portion of the composition and in general ranges from about 60 to 75% by weight.

In the most preferred form, epoxidized castor oil is present at a level of about 20% by weight, and the filler comprises about 65% by weight of untreated hydrated alumina having a Tyler screen analysis of 20 to 35% on 325 mesh. Also, the rigidizer is preferably diglycidyl ether of bisphenol A epoxy and is present at a level of about 5% by weight. The anhydride curing agent can be any one of a number of conventional agents such as benzyldimethylamine and is present at an anhydride to epoxide equivalent ratio of from about 0.8 to 1.2.

In fabrication procedures, the components of the composition are admixed in the usual fashion to develop a pourable casting composition, whereupon the composition is poured into an appropriate insulator mold in the well known manner. After curing, the insulator is removed for further processing and testing.

DESCRIPTION OF THE PREFERRED EMBODIMENT

Figure 2:
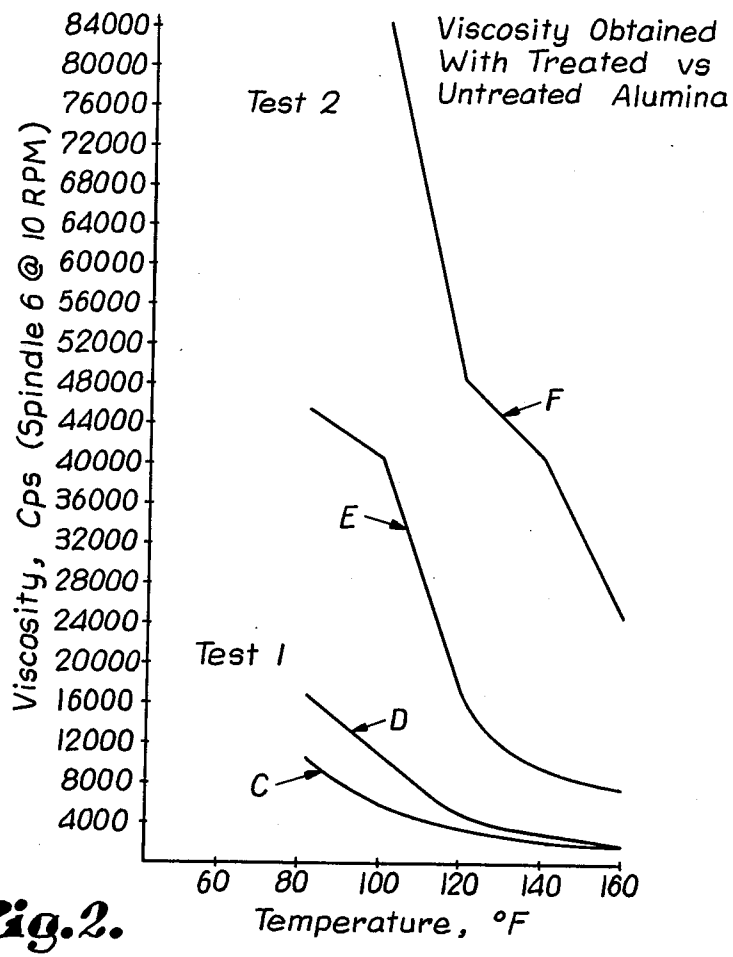
FIG. 2 is a comparative graph illustrating differences in viscosity at various temperatures between treated and untreated alumina casting compositions having therein two different filler loadings.

The high voltage polymeric electric insulator of the present invention comprises a body having at least the outermost portion thereof formed of a synthetic resin composition. The latter includes from about 18 to 22% by weight of epoxidized castor oil reacted with a glycidyl rigidizer and an anhydride curing agent. Moreover, a quantity of hydrated alumina particulate filler is dispersed throughout the synthetic resin materials for increasing the arc track resistance of the ultimate insulator. The filler and quantity thereof are preferably selected from the group consisting of (1) from about 60 to 65% by weight of untreated hydrated alumina and (2) from about 65 to 75% by weight of hydrated alumina which has been treated with an agent for lowering the coefficient of friction of the alumina.

In more detail, the epoxidized castor oil employed in practice is purchased from Celanese Resins, a division of Celanese Coatings Company, N.Y., N.Y., under the designation Epi-Rez 505. This is a low viscosity polyepoxide castor oil resin which is known to impart flexibility, impact resistance and thermal shock resistance when incorporated into a wide variety of epoxy formulations. The product has a viscosity (77° F.) of 300 to 500 Cps., weight per gallon of 8.4–8.55 lbs., a color (Gardner-Holdt) of 8 max., a weight per epoxide of 550–650, and a flash point (approximate, COC) of about 300° F. This material is fully described in a product bulletin entitled "Epi-Rez 505" distributed by the manufacturer, and which is incorporated herein by reference.

The quantity of the selected epoxidized castor oil is also important. It has unexpectedly been found that, in order to achieve the most desirable end properties in the insulator, the epoxidized castor oil should be present at a level of from about 18 to 22% by weight, based upon the overall composition, and most preferably at a level of about 20% by weight. This relatively narrow range of use has been found to give a final insulator which, in conjunction with the other ingredients described below, has the most desirable properties from an overall standpoint.

The rigidizer component is preferably selected from the group consisting of diglycidyl ether of bisphenol A epoxy, diglycidyl phthalate, diglycidyl isophthalate, o-glycidyl phenyl glycidyl ether and the novolac resins. The rigidizer should be present at a level of from about 3 to 7% by weight, most preferably about 5% by weight, and the most advantageous component is the BPA epoxy resin. The BPA component is believed to toughen and lend a measure of rigidity to the relatively flexible nature of the epoxidized castor oil. In practice, an unmodified diglycidyl ether of disphenyl A sold by Celanese Resins under the designation Epi-Rez 510 has been used to good effect. This material is sold as a liquid and has a viscosity (25° C.) of 10,000 to 16,000 Cps., a color (Gardner-Holdt) of 3 max., a weight per gallon of 9.57 to 9.73 lbs., a weight per epoxide ratio of from about 180 to 200, and a 0.1% maximum hydrolyzable chlorine content. Further information regarding this commercially available product can be obtained from a product bulletin distributed by the manufacturer entitled "Epi-Rex 510, Form No. CRL 5174", which is incorporated herein by reference.

The anhydride curing agent of the present invention is preferably selected from the group consisting of methyltetrahydrophthalic anhydride, hexahydrophthalic anhydride, tetrahydrophthalic anhydride and methyl Nadic anhydride. The most preferred curing agent is methyltetrahydrophthalic anhydride. In general, the curing agent should be present at a level to give an anhydride to epoxide equivalent ratio of from about 0.8 to 1.2, and most preferably about 0.9. In terms of weight percent, this normally ranges from about 5 to 11% by weight curing agent in the composition, although this figure is changeable upon the nature of the anhydride itself.

In actual practice, a mixture of isomers of methyltetrahydrophthalic anhydride is employed as the curing agent. This product is distributed by the ArChem Company of Houston, Texas under the designation ECA 110. This product is a light colored, low viscosity liquid curing agent and has an average molecular weight of 162–166, a viscosity (Brookfield 25° C.) of from about 50 to 100 Cps., a specific gravity (25° C.) of 1.19 to 1.20, and a color (Gardner-Holdt) of 3 to 6. Further information regarding this commercially available product is available from the manufacturer in a bulletin entitled "Bulletin EC-110", September 1977, and which is incorporated herein be reference.

An anhydride accelerator is also incorporated into the preferred composition of the invention. Such accelerators may be selected from the group consisting of benzyldimethylamine; 2,4,6-tris-(dimethylaminoethyl) phenol; and the 2-ethylexoic acid salt thereof; 1-methylimidazole; and benzyltrimethylammoniumchloride. The accelerator should be present at a level of from about 0.3 to 0.5% by weight, and most preferably about 0.4% by weight. The most preferred accelerator is benzyldimethylamine, and this product is purchased commercially from Ciba Products Company, Summit, N.J., under the tradename "Accelerator 062." The product has a molecular weight of 135, a refractive index, $n_d$25° C. of 1.500, a specific gravity (25° C.) of 0.90, and a weight per gallon of about 7.51 lbs. Further information in connection with this commercial product is available from a technical bulletin distributed by the manufacturer entitled "Araldite Accelerators: 062, 064, and 066" which is hereby incorporated by reference.

The hydrated alumina fraction of the insulators hereof is important from the standpoint of improving arc track resistance. As noted, the present invention is concerned with unexpectedly high filler loadings, on the order of from about 60 to 75% by weight. In this connection, it has been found that from about 60 to 65% by weight of untreated hydrated alumina can be successfully employed, or correspondingly from about 65 to 75% by weight of hydrated alumina treated with an agent for lowering the coefficient of friction of the hydrated alumina. In the former case, commercially available hydrated alumina sold by Kaiser Chemicals of Baton Rouge, Louisiana under the designation "H-36" has been used to good advantage. This material is of relatively large particle size (Tyler screen analysis, 20 to 35% by weight on 325 mesh, with an average particle size of about 20 microns). This is in contrast with the normal hydrated alumina used as a filler in insulators which is of a smaller particle size (99% through a 325 mesh screen). The preferred H-36 product is fully described in a data sheet distributed by the manufacturer entitled "Hydrated Alumina H-36 Product Data", and the latter data sheet is incorporated herein by reference.

The significance of the use of the preferred, larger diameter hydrated alumina product will be seen when it is appreciated that such material at high use levels does not tend to increase the viscosity of the starting composition to a point rendering the same unpourable. This is in sharp contrast with the conventional practice of using very fine particulate hydrated alumina which tends to greatly increase viscosity at high filler loading levels. At the same time however, use of the larger particle size alumina could predictably have the effect of causing settling of the alumina during the casting process; but it has unexpectedly been found that use of such alumina, along with the other components of the invention, does not give the expected problem, and in fact alumina settling does not occur to any significant degree. Thus, the careful selection of components and proportions allows use of the larger alumina at very high filler loadings without attendant problems of unmanageable viscosity increase or filler settling.

Figure 1:
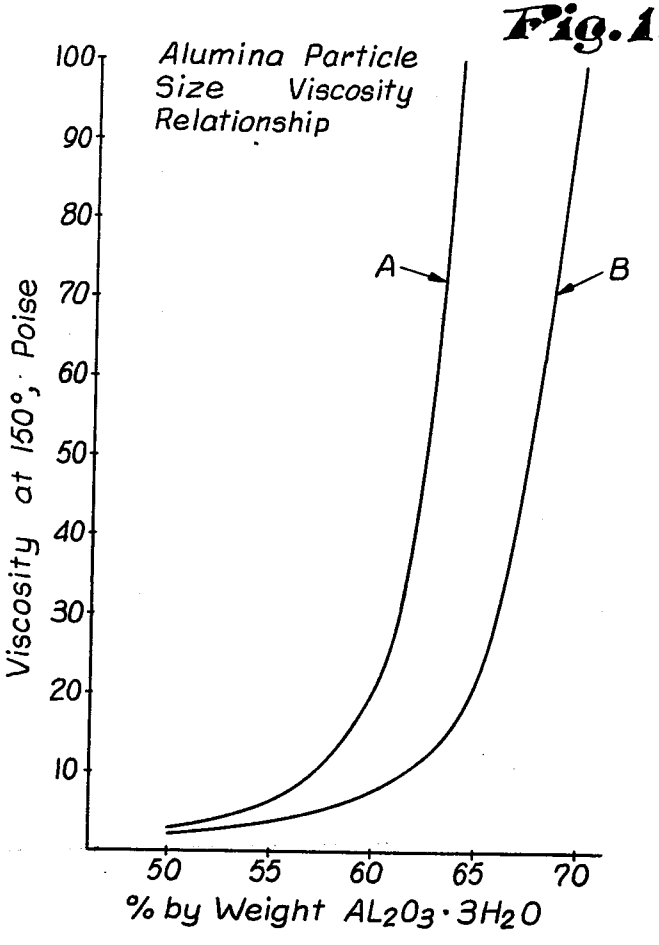
FIG. 1 is a comparative graph illustrating the rise in viscosity attributable to the use of increasing quantities of hydrated alumina of two different average diameters in casting compositions in accordance with the invention.

The advantages which inhere in the use of the larger particle size alumina is graphically illustrated in FIG. 1. In this graph, the viscosity of casting compositions at 150° F. is plotted for various filler loadings. Plot A represents the data developed using the very small particle size alumina (99% through 325 mesh); on the other hand, Plot B represents the data generated using the preferred 20 micron alumina of the invention. At a representative level of 20 poise, it will be seen that less than about 60% by weight of the small particle size alumina can be employed. This is to be contrasted with the situation with Plot B, where at 20 poise the filler loading is approximately 65% by weight. Thus, it will be seen that the larger particle size alumina can be used at higher filler loadings without an attendant unacceptable increase in viscosity which would render the casting composition unpourable.

The treated alumina herein discussed involves the known practice of treating alumina with an agent to lower the coefficient of friction thereof, and thereby lessen the tendency of the alumina to increase viscosity. A number of different products can be used for such treatment purposes, but preferably the treatment agent is selected from the group consisting of a silane coupling agent on an alumina trihydrate carrier and tetra (2,2 diallyloxymethyl-1-butenoxy titanium di(di-tridecyl) phosphite. The silane product can be purchased commercially from Union Carbide Corporation of N.Y., N.Y., and has a bulk density of 43 lbs. per cu. ft., an average particle size of 1 micron, and a flash point (Penske-Martens closed cup) of 80° to 95° F. This product is more fully described in a bulletin distributed by the manufacturer entitled "Product Information Ucarsil Dry Silane Concentrate 20", and this bulletin is incorporated by reference herein. The phosphite product is commercially sold under the name of "Ken React-55", and is distributed by Kenrich Petrochemical, Inc., of Bayonne, N.J.

Treating of hydrated alumina with these types of agents is a known process, and generally involves intimately admixing the alumina and treating agent, either before or during formulation of the overall casting composition, such that the treating agent physically reacts with the alumina. Normally, the agent is present at a level of from about 1½ to 3% by weight, based upon the weight of the alumina to be treated taken as 100%.

Attention is now directed to FIG. 2. This is a graphical representation of data collected in connection with the preferred large particle size H-36 alumina. In the graph, two tests are recorded, and two separate plots are provided for each test. In Test 1, 65% of the H-36 hydrated alumina was used in the preparation of a casting composition in accordance with the invention. In the case of Plot C, the alumina was treated with the Ken React-55 product, whereas in Plot D, the alumina was untreated. Likewise, in Test 2, a 70% hydrated alumina loading was employed in the same composition. In Plot E, the alumina was treated with the Ken React-55

-product, and in Plot F the alumina was untreated. Each of the plots C, D, E and F measure viscosity increase at the given filler loading as a function of temperature. In each test it will be seen that the testing compositions including the treated fillers (Plots C and E) exhibited significantly lower viscosities over the measured temperatures. The effect is more pronounced in the case of Test 2, but nevertheless is clearly discernible in Test 1 as well. Therefore, the advantageous results which flow from the use of alumina treated in accordance with the invention is manifest.

In fabrication procedures, the components of the casting composition (i.e., the epoxidized castor oil, rigidizer, curing agent, filler, and accelerator) are admixed in the usual fashion. In many cases a pigment and UV stabilizer can be added in minor amounts to the formulation, along with other optional ingredients. The composition is then cast, again using conventional techniques, to give the final insulator. Inasmuch as the fabrication techniques involved in the production of the insulators hereof are essentially conventional, a detailed discussion thereof is unnecessary and is omitted.

The finished insulators in accordance with the invention exhibit a wide variety of desirable properties which have heretofore been unobtainable in a single insulator. Specifically, excellent arc track and flame resistance are evident, along with good weatherability and antifungal properties. At the same time, the preferred insulator is formed of a highly filled casting composition which nevertheless can be poured for casting purposes and avoids the problems of unmanageable viscosity buildup and/or filler settling.

In order to demonstrate the functionality of the present insulators, as opposed to known prior unfilled insulators, the following test was conducted:

EXAMPLE

In order to test important features of the instant preferred insulator as compared with a known prior insulator, the following experiment was undertaken.

First, standard 15 kV deadend insulators of the preferred type described in U.S. Pat. No. 3,838,055 were prepared. These insulators included a rigid fiberglass core surrounded by an insulative matrix formed as a series of spaced, circumferential skirts. The matrix was fillerfree and comprised a hydrophobic, thermosetting aromatic BPA epoxy resin flexibilized with glycidyl ether of castor oil. In these insulators, the matrix comprised approximately 50 parts by weight epoxidized castor oil (Epi-Rex 505, Celanese Resins, N.Y., N.Y.) and 50 parts by weight high molecular weight diglycidyl ether of bisphenol A (Epi-Rez 519, sold by Celanese Resins, N.Y., N.Y.), cured with a conventional anhydride curing agent at an anyhdride to epoxide equivalent ratio of about 0.9.

As a comparison, identical insulators were produced using the preferred formulation for the outer insulative portion. Specifically, the outer insulative portion of the insulators was a filled system having, in approximate parts by weight (with the respective trade names and manufacturers in parenthesis): 65 parts hydrated alumina Tyler screen analysis, 20–35% on 325 mesh (H-36 hydrated alumina sold by Kaiser Chemicals of Baton Rouge, La.); 20 parts epoxidized castor oil (Epi-Rez 505 sold by Celanese Resins, a division of Celanese Coatings Company, of N.Y., N.Y.), 5 parts diglycidyl ether of bisphenol A (Epi-Rez 510 sold by Celanese Resins, N.Y., N.Y.); 8 parts of a mixture of isomers of methyltetrahydro phtholic anhydride (ECA 110 sold by Ar-Chem Company, of Houston, Tex.), to give an anhydride to epoxide equivalent ratio of about 0.9; and 0.4 parts benzyldimethylamine (Araldite 062 accelerator sold by Ciba Products Company, of Summit, N.J.)

The sets of insulators were then subjected to identical comparative tests to determine the overall functionality thereof as insulators. The following Table sets forth the results of these tests:

TABLE

| | Test Property | Known Insulator | Insulator of Invention |
|---|---|---|---|
| 1 | Inclined Plane Track Resistance, ASTM D-2303 (4.5kV, 1.6 ml/min. std. solution), Minutes to failure (range) | 6–50 | 100–300 |
| | (average) | 27 | 181 |
| | Comments: | Tracked and caught fire | Erosion occurred |
| 2 | Dry Arc Track Test ASTM D495, Seconds to Failure (range) | 10–15 | 180–190 |
| | (average) | 12 | 186 |
| | Comments: | Tracked | Erosion |
| 3 | Vertical Tracking Wheel (10kV), Hours to failure (range) | 300–1500 | 300–1100 |
| | (average) | 886 | 695 |
| | Comments: | Surface Tracked | Erosion to Rod then rod tracked |
| 4 | Horizontal Tracking Wheel (20kV), Hours to failure (range) | 100–2000 | 300–900 |
| | (average) | 300 | 500 |
| | Comments: | Surface Tracking | Salt accumulation |
| 5 | Flammability (ASTM D635): held horizontal, in burner flame, for 30 sec. Self extinguishing time, seconds (range) | 400–800 | 1 |
| | (average) | 600 | 1 |
| 6 | Pendulum Impact Strength (72° F.) inch lbs. (range) | 50–170 | 140–170 |
| | (average) | 130 | 160 |
| 7 | Hardness, Shore D | 65–80 | 55–70 |
| 8 | Unnotched Izod Impact Strength ASTM D256 | 25–30 ft-lb/in | 2–5 ft-lb/in |
| | Comments: | Complete break | Hinge break |

With respect to the above tests, Nos. 1, 2, 5 and 8 are standard ASTM tests, and therefore the protocols thereof need not be described in detail. The vertical tracking wheel test involved use of a large circular wheel rotatable about a horizontal axis which had mounted thereon a plurality of circumferentially spaced, radially inwardly extending insulators, such that the latter were arranged in a spoke-like fashion. The wheel was rotated at one revolution per minute, and water was sprayed adjacent the lower end of the wheel onto the rotating insulators. This water had a resistivity of 1200 ohm-cms. The energized lead was at the axis of the wheel, whereas the grounded lead was disposed about the periphery of the wheel in contact with the outermost ends of the rotating insulators. Rotation of the insulators was continued, using a 10 kV potential across the insulators, until failure.

The horizontal tracking wheel test was similar, but in this case the wheel was rotatable about a vertical axis and the respective insulators were positioned in circumferentially spaced relationship about the periphery of the wheel in an upright orientation parallel to the axis of rotation. In this instance the upper end of the insulators were contacted with the energized lead, whereas the bottom thereof were grounded. The wheel was rotated at one revolution per minute, with 20 kV potential across the insulator, and water (1200 ohm-cms resistivity) was continually sprayed from one location onto the rotating insulators.

In analyzing the vertical and horizontal tracking wheel data, it is important to recognize that the mode of failure of the insulators is more important than the actual time of failure. That is to say, an insulator that fails by virtue of tracking is always considered inferior to an insulator which fails by virtue of erosion or salt accumulation. This is so even though failure due to the last mentioned causes may be lesser in time than tracking failure. Thus, in comparing the known insulator and those of the instant invention, it will be seen that the former failed in both the vertical and horizontal tracking wheel tests because of surface tracking; on the other hand, the instant insulators failed due to the erosion and salt accumulation respectively. Thus, the superiority of the present insulators is established.

Also, tests 1 and 2 further establish this superiority because of the significant increases in tracking failure times experienced with the insulators of the present invention versus the known insulators.

The remainder of the tests (5–8) further illustrate the marked improvement of the present insulators. Specifically, flame out time (test No. 5) was essentially instantaneous with the insulator of the invention, whereas the prior insulators burned for a considerable period.

In the impact strength test the insulators were subjected to increasing impact shocks from a pendulum. The insulators of the invention had a greater impact strength than those of the prior art. Shore D hardness tests (No. 7) illustrate that the present insulators are less brittle than those of the known variety; and as explained above, this is a particularly desirable feature. The flexible, yet rugged, nature of the present insulators is further illustrated in Test No. 8. With the known insulator, an impact of 25–30 ft-lb/in was required, and resulted in a complete break. On the other hand a desirable hinge break was achieved with the present insulators at a level of about 2–5 ft-lb/in. In the latter connection it will be understood that the ASTM Izod Impact test lists four possible results: complete break where the sample breaks into two or more pieces; a hinge break where the sample is broken on the side of impact and is bent; partial break where the sample is broken on one side without bending of the sample; and no break. In the case of insulators for use in a variety of ambient conditions, it has been determined that a hinge break or partial break should be achieved, as opposed to complete or no break. In the case of the latter two results, the insulator is far too rigid and brittle.

In summary then, it will be seen that the insulators of the present invention give significantly enhanced results over a wide spectrum of conditions and tests which are known to be indicative of insulator problems and conditions in the field. Primary among these are the much improved resistance to tracking, very low flamability, and the flexible, yet rugged, nature of the insulator.

Having thus described the invention, what is claimed as new and desired to be secured by Letters Patent is:

1. A high voltage, arc track resistant, polymeric electrical insulator, comprising:
   - a body having at least the outermost portion thereof formed of a cured, filled synthetic resin composition including, wherein all percentages are based upon the overall composition taken as 100%
   - a synthetic resin matrix including from about 18 to 22% by weight of epoxidized castor oil reacted with a glycidyl rigidizer, and an anhydride curing agent;
   - a quantity of particulate filler dispersed throughout said matrix for increasing the arc track resistance of said insulator,
   - said filler and quantity thereof being selected from the group consisting of (1) from about 60 to 65% by weight of untreated hydrated alumina, and (2) from about 65 to 75% by weight of hydrated alumina treated with an agent for lowering the coefficient of friction of the hydrated alumina.

2. The insulator as set forth in claim 1 wherein said rigidizer is selected from the group consisting of diglycidyl ether of bisphenol A epoxy, diglycidyl phthalate, diglycidyl isophthalate, o-Glycidyl phenyl glycidyl ether and the novolac resins.

3. The insulator as set forth in claim 1 wherein said rigidizer is present at a level of from about 3 to 7% by weight.

4. The insulator as set forth in claim 1 wherein said curing agent is present at an anhydride to epoxide equivalent ratio of from about 0.8 to 1.2.

5. The insulator as set forth in claim 1 including an accelerator selected from the group consisting of benzyldimethylamine, 2,4,6-tris-(dimethylaminoethyl) phenol and the 2-ethylexoic acid salt thereof, 1-methylimidazole and benzyltrimethylammoniumchloride.

6. The insulator as set forth in claim 5 wherein said accelerator is present at a level of from about 0.3 to 0.5% by weight.

7. The insulator as set forth in claim 1 wherein said alumina has a particle size such that from about 20 to 35% thereof will not pass through a 325 mesh screen.

8. The insulator as set forth in claim 1 wherein said treated alumina is treated with an agent selected from the group consisting of a silane coupling agent on an alumina trihydrate carrier, and tetra (2,2 diallyloxymethyl-1-butenoxy titanium di (di-tridecyl) phosphite, said agent being present at a level of from about 1½ to 3% by weight, based upon the weight of alumina treated taken as 100%.

9. The insulator as set forth in claim 1 wherein:
   - said rigidizer comprises diglycidyl ether of bisphenol A epoxy and is present at a level of from about 3 to 7% by weight;
   - said curing agent comprises methyltetrahydro phthalic anhydride and is present at a level of from about 5 to 11% by weight;
   - said matrix includes an anhydride for said curing agent; and
   - said filler comprises about 65% by weight of untreated hydrated alumina having a particle size such that from about 20 to 35% thereof will not pass through a 325 mesh screen.

10. The insulator as set forth in claim 1 wherein said curing agent is selected from the group consisting of methyltetrahydrophthalic anhydride, hexahydrophthalic anhydride, tetrahydrophthalic anhydride and methyl Nadic anhydride.

11. The insulator as set forth in claim 1 wherein said anhydride is present at a level of from about 5 to 11% by weight.

* * * * *